United States Patent [19]

Oxley

[11] Patent Number: 5,076,625

[45] Date of Patent: Dec. 31, 1991

[54] ELECTRIC STRIKE

[76] Inventor: Randall C. Oxley, 1011 High St., Bridgewater, Mass. 02324

[21] Appl. No.: 666,422

[22] Filed: Mar. 7, 1991

Related U.S. Application Data

[63] Continuation of Ser. No. 407,200, Sep. 14, 1989, abandoned.

[51] Int. Cl.[5] ..... E05C 3/16

[52] U.S. Cl. ..... 292/341.16; 292/201

[58] Field of Search ..... 292/341.16, 216, 201, 292/229, DIG. 72

[56] References Cited

U.S. PATENT DOCUMENTS

| | | | |
|---|---|---|---|
| 381,725 | 4/1888 | Schneider | 292/341.16 |
| 1,060,234 | 4/1913 | De Guise | 292/341.15 |
| 1,471,455 | 10/1923 | Ernst | 292/341.16 |
| 1,529,276 | 4/1925 | Rich | 292/341.16 |
| 2,066,278 | 12/1936 | Keil | 292/341.16 |
| 2,848,263 | 8/1958 | Miller | 292/210 |
| 3,211,850 | 10/1965 | Toepfer | 200/61.64 |
| 3,325,203 | 6/1967 | Moler | 292/229 X |
| 3,504,511 | 4/1970 | Allen | 292/201 X |
| 3,640,560 | 2/1972 | Zawadzki et al. | 292/341.16 |
| 3,765,709 | 10/1973 | Van Wyck | 292/341.16 X |
| 3,804,442 | 4/1974 | Powers | 292/341.16 |
| 3,819,215 | 6/1974 | Fuss | 292/341.16 |
| 3,861,727 | 1/1975 | Froerup et al. | 292/341.16 |
| 3,890,813 | 6/1975 | Cothron | 292/210 |
| 3,910,617 | 10/1975 | Scalza et al. | 292/341.16 |
| 4,056,276 | 11/1977 | Jarvis | 292/201 |
| 4,088,354 | 5/1978 | Kolendowicz | 292/201 |
| 4,211,443 | 7/1980 | Butts et al. | 292/341.16 |
| 4,470,625 | 9/1984 | Walsh et al. | 292/201 |
| 4,471,983 | 9/1984 | Bischoff et al. | 292/341.16 |
| 4,595,220 | 6/1986 | Hanchett, Jr. et al. | 292/341.17 |
| 4,613,176 | 9/1986 | Kelly | 292/201 |
| 4,703,960 | 11/1987 | Lense | 292/201 X |

FOREIGN PATENT DOCUMENTS

| | | | |
|---|---|---|---|
| 333465 | 6/1903 | France | 292/341.16 |
| 1010960 | 4/1952 | France | 292/229 |

*Primary Examiner*—Eric K. Nicholson

*Attorney, Agent, or Firm*—Lahive & Cockfield

[57] ABSTRACT

An electric door strike includes a rotatable keeper body which is secured against rotation by a solenoid-operated latching mechanism. The keeper is biased toward a released position, and is returned to a latched position by rotation when the door closes against a protruding stop member which is rotationally and horizontally offset from the keeper. The strike is of particular utility for electric conversion of existing door locks.

4 Claims, 3 Drawing Sheets

ELECTRIC STRIKE

This application is a continuation of application Ser. No. 407,200, filed Sept. 14, 1989 now abandoned.

BACKGROUND OF THE INVENTION

The present invention relates to door closure mechanisms, and more particularly to electrically actuated mechanisms for maintaining a door closed and for electrically releasing the door so that it may open.

Numerous latching mechanisms of this type have been developed, some of which consist of specially matched sets of hardware for mounting on both the door and its frame, and others of which mount only on the door frame and adapt it to receive a door having an existing non-electric mechanism. Typically, the actuation of such devices is effected by an electric solenoid, which retracts a latching member on the frame, or actuates a mechanism that releases a latching member from engagement with the mating structure mounted on the door.

One commonly used device of this sort is an electric strike such as that shown in U.S. Pat. No. 4,211,443 issued on July 8, 1980 to the Folger Adam Company. In that device, a keeper is rotatably mounted in a strike mechanism and is spring-biased to an outwardly-extending latched position. The opposite, or inside, face of the rotatable keeper has a curved surface leading to a step or abutment against which a pivoting arm rests to prevent rotation of the keeper, and a latch member normally secures the free end of the pivoting arm to prevent the arm from swinging away from the step. A solenoid retracts the latch and releases the keeper for rotation, so that when the solenoid is actuated and the door is simultaneously pulled, the keeper will rotate and release the door. The keeper, being spring biased, rotates back into a latching position once the door is opened. The keeper and housing are each of a heavy cast or forged metal construction.

This strike construction with a rotating keeper mounted in a strong housing prevents the strike from being pried into a release position, and also isolates the rather weak solenoid and pivot arm structure from the great forces which may sometimes be applied to a door closure. However, it essentially requires that the door-mounted portion of the latching mechanism, such as a post or fork, be retracted in order to reclose the door. This may require manual actuation of the door, which can be a nuisance when it is considered that a primary function of an electric strike is to permit remote control of an entry way.

SUMMARY OF THE INVENTION

Accordingly, it is desirable to provide an electric strike mechanism for releasably securing a door which allows ready opening and closing of the door with diverse door mechanisms.

This is achieved in accordance with the invention by providing a strike having a keeper assembly consisting of a pivoting keeper body with a protruding keeper and a protruding stop. The pivoting body is rotatable between a first position in which blocking member secures it against rotation, and the keeper portion fully extends from the face of the strike, and a second position in which the keeper has rotated to a shallowly-extending release position disengaged from a fork or recess at the edge of a door. A spring biases the pivoting body in the second position, so that the keeper is returned to its latched position only when the door is closed, striking the stop, and rotating the pivoting body against the force of the biasing spring. Thus, neither the electric strike, nor the recess or other mating lock mechanism of the door requires specific actuation or resetting to again lock the door. The strike is especially adapted to provide an electric release for doors not having a Pullman latch or similar retractable mechanism, such as commonly used on fire doors and emergency exits, and may be adapted to latching the top or side edge of a door.

BRIEF DESCRIPTION OF THE DRAWINGS

These and other features of the invention will be understood by reference to the description herein, taken together with the claims appended hereto and the drawings, wherein:

DETAILED DESCRIPTION OF THE INVENTION

Figure 1:
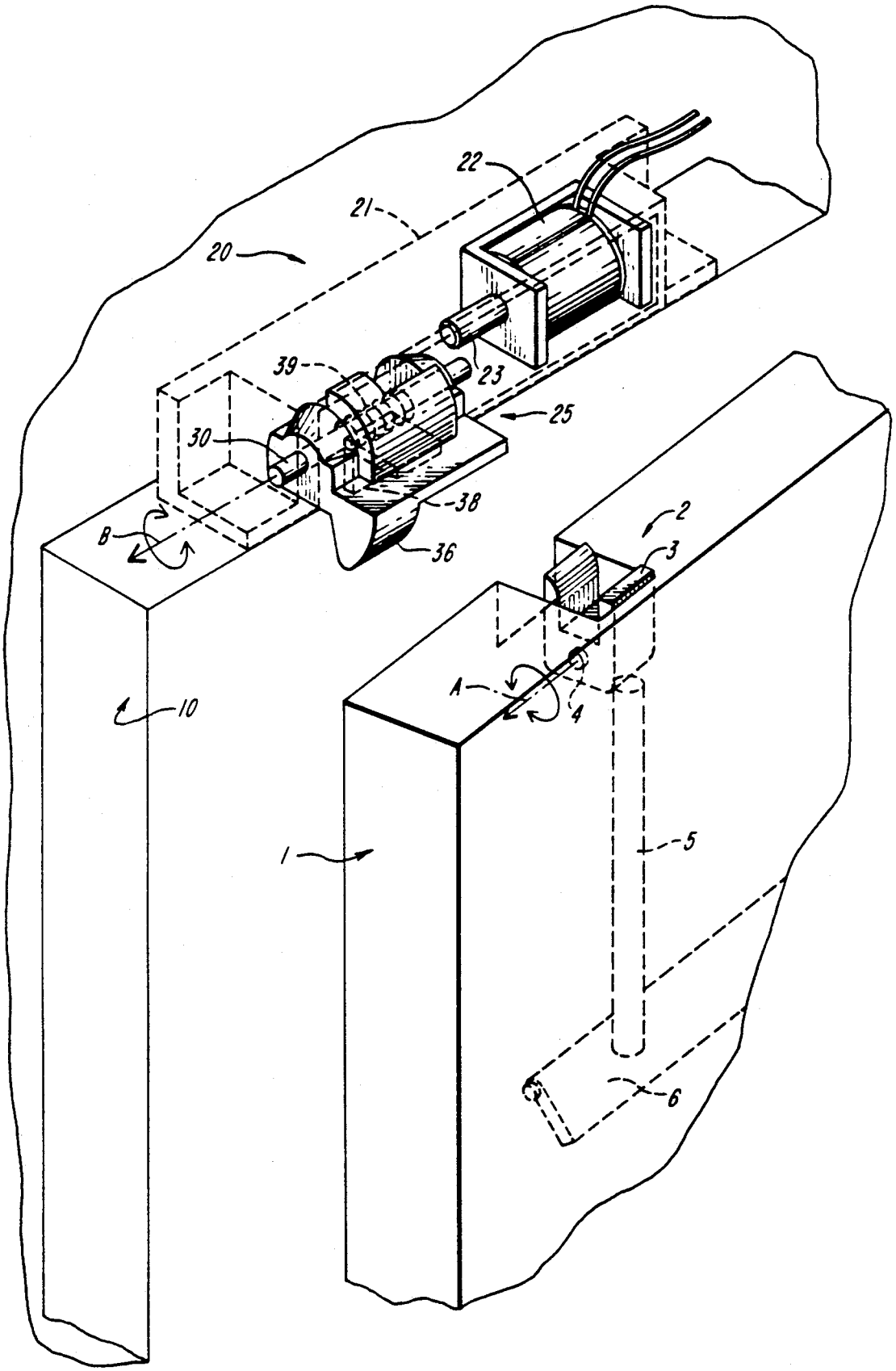
FIG. 1 is a perspective view, partially in phantom and cutaway, of one embodiment of the invention.

FIG. 1 is schematic top perspective view showing an electric strike 20 according to the present invention, which mounts on a door frame 10 and engages a mechanism 2 mounted on the door 1. The illustrated door mechanism is a deadlocking-type latch consisting of a forked member 3, called a tongue, mounted on a pivot shaft 4 so that it may pivot about the axis A of the shaft 4 only when released by movement of a rod 5. Rod 5, in turn, is actuated by a manual release bar 6 or by a keeper to rotate slightly counter-clockwise to bring the outer edge of the nub 36 horizontal and thereby release the fork.

According to a principal aspect of this invention, keeper body 25 is not biased into a locked position, but rather is rotationally biased into a position such that nub 36 remains retracted when it is released by solenoid 22 and the door is opened. As the door 1 swings open, the horizontal translation of fork 3 rotates the keeper body by about twenty to seventy degrees such that as the nub 36 attains a substantially recessed and horizontal position, an adjacent protrusion 38 (shown in phantom) rotates downwardly to form a contact member or door stop. When the door is swung closed, the protruding door stop 38 contacts the face of the door and rotates the keeper body 25 back into its locking position. As visible more fully in FIGS. 3, 4 the nub 36 has generally rounded cam-like lobed shape which allows it to protrude vertically into the recessed fork 3, while rotating out of the fork as the door is opened without any release or rotational motion of the fork itself. Thus, the manual operation of the release bar 6 is not required. Similarly, the horizontal swing of the door rotates the nub in a reverse direction back into the securely locked fork.

Biasing of the keeper toward its retracted position, rotated outward from the plane of FIG. 1, is accomplished by a torsion spring 39, which is shown in phantom fitted around keeper body shaft 30 and rotationally bearing against an inner edge of the keeper body. A leaf spring or other spring may be used.

A suitable mechanism for locking and releasing the keeper body 25 is most easily described by reference to a commonly available electric strike such as illustrated in issued U.S. Pat. No. 4,211,443. This is essentially a mechanism consisting of a first lever arm which rides against the curved back surface of the keeper body and is spring loaded to flip down against a step or steeply sloped camming region in the back surface, and of a second lever-like arm which has a pawl to engage the free end of the first lever arm and prevent it from sliding off the step when the assembly is subjected to prying, rocking or impact. The solenoid retracts the pawl to release the keeper.

Figure 2:
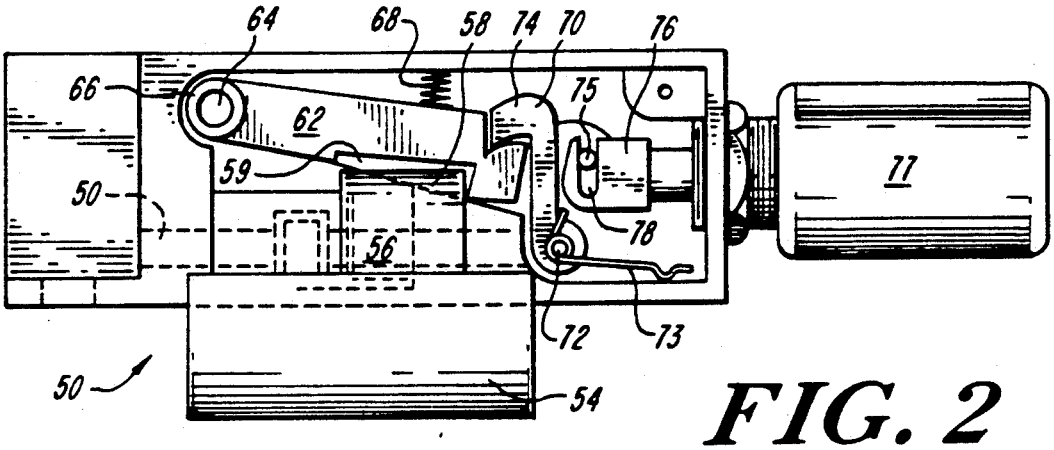
FIG. 2 (PRIOR ART)
FIG. 2 is a side elevation of a prior art electric strike, illustrating representative latching elements for blocking and for enabling rotation of a keeper.

As shown in FIG. 2, such a prior art electric strike 50 has an outwardly biased pivotal keeper body 56 with an outer surface that constitutes a keeper 54 and which rotates about a pin 55. The keeper body has an integrally formed cam surface 58 on an interior surface, on which a locking lever 62 rides as it pivots on a pin 64 and bushing 66. The cam surface 58, after a certain rotational extent, has a step or groove into which the locking lever 62 is urged by a spring 68, thereby blocking rotation of the keeper body 56.

To lock the lower end of the locking lever in a rotation-blocking position, a locking cam 70 is pivotally mounted in the housing on a pin 72 and is biased by a spring 73 such that a pawl 74 extending from the cam holds the free end of the lever 62. A pin on the cam is gripped by a hook assembly 76 on the arm of solenoid 77, and slides in a slot 78 of that assembly to rotate the pawl out of engagement and allow locking lever 62 to rise from its blocking position for opening the door. Rotational force on the keeper body causes locking lever 62 to ride up a steep portion of cam surface 58, thereby freeing the keeper body to rotate. A bevelled region 59 of arm 62 cooperates in the conversion of rotational force of keeper body 58 into vertical lift of lever 62. Reference is made to the aforesaid U.S. patent for a more detailed discussion of the properties and mechanical structure of such solenoid actuated lever-type keeper blocking and release mechanism. What is important for purposes of this patent application is that such an intermediate lever-type structure is contemplated as one suitable electromechanical interlock for a rotating keeper body as described above in relation to FIG. 1.

Figure 2A:
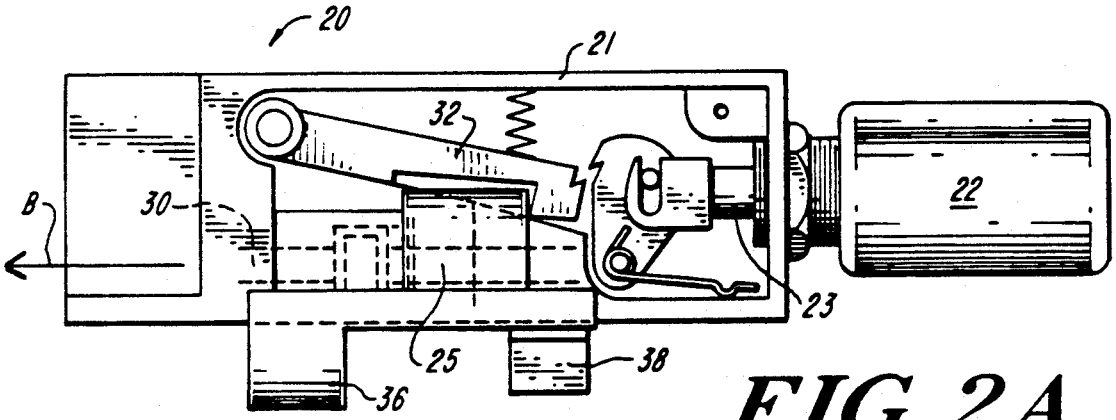
FIG. 2A illustrates details of a suitable rotation-blocking mechanism in the present invention.

FIG. 2A is a view comparable to that of FIG. 2, showing one adaptation of the locking mechanism to applicant's electric strike. Essentially, the inside surface 25 of the rotating element and locking lever 32 are configured like the surface 58 and lever 62 of the prior art device. Like the prior art device, the strike relies on pressure from the door being exerted on the keeper to rotate the body 25. Unlike that device, however, the keeper body is rotationally biased toward its open position, so that once the keeper body has rotated open and the lever 32 has been urged upward out of its blocking position, the keeper body remains in that position until rotated back by motion of the door.

Figure 3:
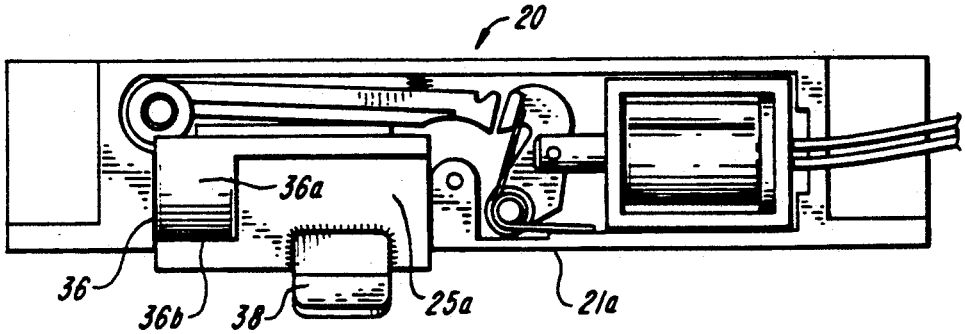
FIG. 3 is a view of the electric strike of FIG. 1 with the keeper rotated to a release position.

FIG. 3 illustrates the shape of, and the approximate range of rotation of the keeper body employed in the present invention. As shown in FIG. 3, the keeper 36 is shaped like a rounded lobe having a steep door-facing side **36*a* and a rounded inner side 36*b* adapted to "roll into", or out of, the fork. The lobe is formed at one end of a generally flat surface 25*a* of the keeper body. The flat surface, in the locked position, is parallel to and flush with the lower surface 21*a* of the housing 20, causing the lobe to project vertically downward. At the other end of the surface 25*a*, and offset along the direction of door thickness, the stop plate 38 projects outwardly at right angles from surface 25*a*. Thus, when body 25 rotates, the keeper 36 rotates upward, rising above the plane of strike plate 21*a*, while rotating the stop 38 down into the door opening. The total degree of rotation, visible in the rotated-open position of FIG. 3, is under one-quarter rotation and corresponds to the slope of side 36*b***, being effective to make that side substantially horizontal or even recessed.

Figure 4:
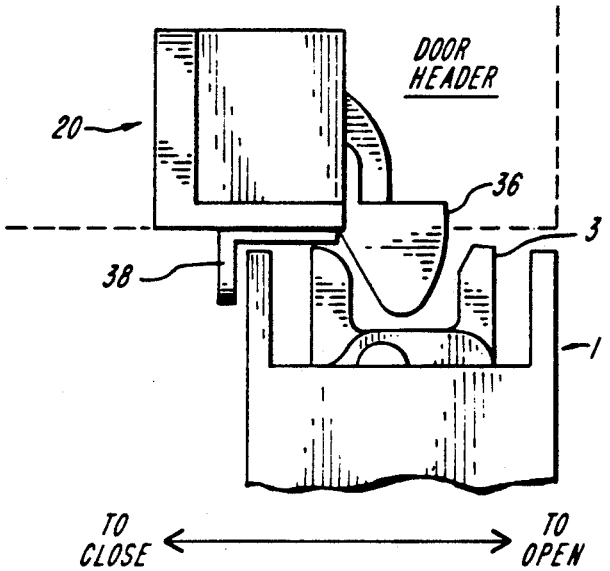
FIG. 4 is a side view of the strike of FIG. 1 with the keeper engaging a fork-type latch.

FIG. 4 is an edge view, along the direction of the doorway header, of the device of FIG. 1, showing the door stile in a closed position with glass removed. As shown, the stop 38 abuts the edge of the door stile, while the strike 36 is centered in the fork 3, or in a fixed groove or depression, in the top edge of the door. Thus, the spacing between the center lines of the projections 36, 38 corresponds to approximately one-half the door thickness.

Figure 5:
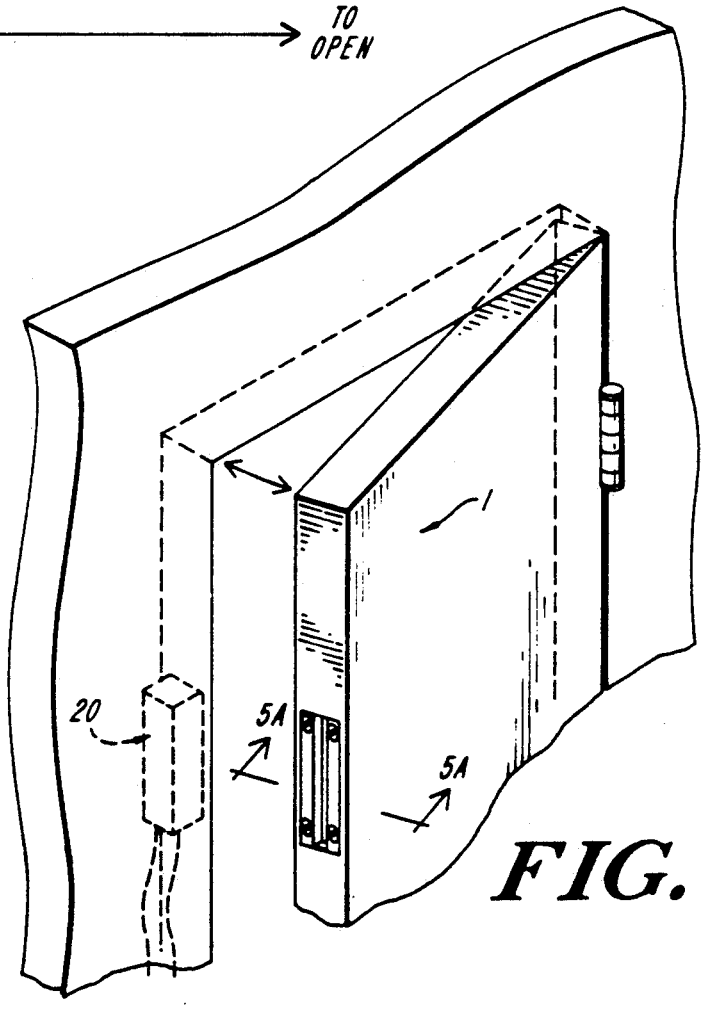
FIG. 5 shows an alternative mounting configuration of the strike of mechanism.
Figure 5A:
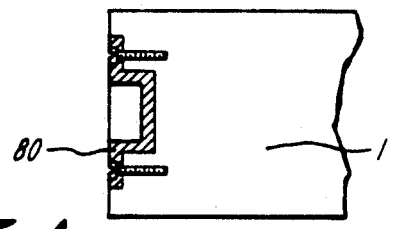
FIG. 5A illustrates a recessed plate for engaging the strike mechanism.

FIG. 5 illustrates an alternative mounting for the electric strike according to the invention. As shown therein, the housing 21 is mounted vertically along the edge of the doorway. In this embodiment, unlike the deadlock retrofit discussed above, the strike preferably engages a fixed recess in the edge face of the door. This may be effected by a strike plate 80, illustrated in sectional view FIG. 5A.

It will be appreciated that the invention provides a handy solution to the problem of providing an electric door opener for a class of existing door constructions while retaining the strength of the existing structure. The invention being thus described with reference to particular embodiments thereof, further variations and modifications will occur to those skilled in the art, and such variations and modifications are considered to be within the scope of the invention, as set forth in the following claims.

What is claimed is:

1. An electric strike mechanism for mounting in the header of a doorway to engage a door and releasably secure the door while permitting the door to open when the strike mechanism is electrically actuated, such mechanism comprising a housing elongated along an axis for fitting into a recess in said header and having an external wall oriented therealong, a keeper body pivotally mounted in said housing for pivotal motion about the axis between first and second positions, said keeper body having an inner contoured face in the form of a cam surface with an abutment groove configured for engagement with a locking arm which rides along the cam surface and is spring-loaded to engage the groove in a rotation-blocking assembly, and an outer face including a keeper in the form of a rounded nub protruding therefrom at an angle effective when said keeper body is in said first position to engage a releasable tongue mechanism in a closed door, the rounded nub being contoured to roll into or roll out of the tongue mechanism as the door is closed or opened, respectively, and the keeper mechanism relying on pressure exerted by the door to rotate the keeper body between positions, a solenoid and an associated rotation-blocking assembly including said arm, and release means interconnecting the solenoid and the arm for lifting the arm from the groove, secured to said housing and operative when said keeper body is in said first position to block rotation of said keeper body until the solenoid is actuated thereby preventing opening of the door, and when the solenoid is actuated permitting rotation, the rounded nub being contoured such that opening of the door exerts lateral pressure on the keeper to rotate the keeper body to said second position in which the arm is cammed above the groove and the keeper body may rotate, stop means protruding from said outer face of the keeper body for stopping the door, said stop means being positioned when the keeper body is in said second position for contacting the open door as the door is closed to rotate the keeper body back to aid first position such that the rounded nub rotates into interlocking engagement with the releasable tongue, and means biasing said keeper body in the second position so that after the door is opened the keeper body is maintained in said second position and may rotate so that it engages the door and locks without further operation of the solenoid or the releasable tongue mechanism as the door is closed.

2. An electric strike according to claim 1, wherein said releasable tongue is a recessed tongue of a deadlocking door latch.

3. An electric strike according to claim 1, wherein said keeper and said stop means include respective contact faces which are angularly offset about said keeper body by an amount effective to contact the door and to bring the keeper into engagement with the releasable tongue mechanism as the door is closed against said stop means and are also offset from each other along said axis.

4. An electric strike according to claim 3, wherein said keeper body rotates between thirty and seventy degrees.

* * * * *